US009555383B2

(12) United States Patent
Daub et al.

(10) Patent No.: US 9,555,383 B2
(45) Date of Patent: Jan. 31, 2017

(54) MIXING CHAMBER, CARTRIDGE, AND METHOD FOR MIXING A FIRST AND A SECOND COMPONENT

(75) Inventors: Martina Daub, Weissach (DE); Juergen Steigert, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 557 days.

(21) Appl. No.: 13/448,679

(22) Filed: Apr. 17, 2012

(65) Prior Publication Data

US 2012/0269030 A1 Oct. 25, 2012

(30) Foreign Application Priority Data

Apr. 20, 2011 (DE) ..... 10 2011 007 779

(51) Int. Cl.

| | |
|---|---|
| ***B04B 1/04*** | (2006.01) |
| ***B01F 13/08*** | (2006.01) |
| ***B01F 9/00*** | (2006.01) |
| ***B01F 11/04*** | (2006.01) |
| ***B01F 15/02*** | (2006.01) |
| ***B01L 3/00*** | (2006.01) |

(52) U.S. Cl.

CPC ..... *B01F 13/0854* (2013.01); *B01F 9/002* (2013.01); *B01F 9/0003* (2013.01); *B01F 11/04* (2013.01); *B01F 15/0212* (2013.01); *B01F 15/0223* (2013.01); *B01F 15/0233* (2013.01); *B01L 3/5021* (2013.01); *B01L 2400/0683* (2013.01); *B01L 2400/086* (2013.01)

(58) Field of Classification Search

CPC ..... B01F 11/00; B01F 13/0854; B01F 9/0003; B01F 9/002

USPC ..... 366/112, 114, 118, 127, 128, 273, 317, 366/332; 210/321.6, 512.1, 512.2, 512.3; 494/4, 494/44

See application file for complete search history.

(56) References Cited

U.S. PATENT DOCUMENTS

| | | | | |
|---|---|---|---|---|
| 3,384,354 | A * | 5/1968 | Migule et al. | 366/118 |
| 4,732,487 | A * | 3/1988 | Pollard | 366/112 |
| 5,360,410 | A * | 11/1994 | Wacks | 604/232 |
| 6,386,751 | B1 | 5/2002 | Wootan et al. | |
| 2003/0179647 | A1 | 9/2003 | Simba | |
| 2005/0184012 | A1* | 8/2005 | Coull | A61M 1/029 210/321.6 |
| 2009/0129973 | A1 | 5/2009 | Emerson | |
| 2010/0261595 | A1 | 10/2010 | Schaefer et al. | |
| 2011/0013474 | A1* | 1/2011 | Ludwig et al. | 366/273 |

FOREIGN PATENT DOCUMENTS

| | | | |
|---|---|---|---|
| CN | 1627985 | A | 6/2005 |
| DE | 970 926 | | 11/1958 |
| DE | 74 35 369 | | 2/1975 |
| DE | 30 36 538 | A1 | 5/1982 |
| EP | 1 106 253 | A2 | 6/2001 |
| EP | 1 533 024 | A1 | 5/2005 |
| WO | 2011/117148 | A1 | 9/2011 |

* cited by examiner

*Primary Examiner* — Tony G Soohoo
*Assistant Examiner* — Anshu Bhatia
(74) *Attorney, Agent, or Firm* — Maginot, Moore & Beck LLP

(57) ABSTRACT

A mixing chamber includes a container for receiving a first and a second component; an obstacle structure, which is designed such that, under the effect of a centrifugal force or magnetic force acting on the mixing chamber, it moves through the first and second components in the container and mixes them with each other; and a connection piece, which is connected at one end to the container and at the other end to the obstacle structure.

14 Claims, 11 Drawing Sheets

MIXING CHAMBER, CARTRIDGE, AND METHOD FOR MIXING A FIRST AND A SECOND COMPONENT

This application claims priority under 35 U.S.C. §119 to German patent application no. DE 10 2011 007 779.0, filed Apr. 20, 2011, the disclosure of which is incorporated herein by reference in its entirety.

BACKGROUND

The present disclosure relates to a mixing chamber, cartridge, and method for mixing a first and a second component.

The document DE 30 36 538 C2, for example, describes a swivel beaker centrifuge for centrifuging blood. The purpose of such centrifuges is to separate substances in the centrifuge material space using mass inertia: particles or liquids of greater density migrate outward as a result of the greater inertia. In doing so, they displace the constituents of lower density, which in this way arrive at the center.

SUMMARY

Compared to conventional solutions, the mixing chamber, the cartridge and the method described herein have the advantage that, instead of the known separation of two liquids of different density for example, it is possible to achieve an effective mixing of the two liquids. For this purpose, under the effect of the centrifugal force and/or magnetic force, the obstacle structure is moved through the two liquids in the container, as a result of which these liquids are mixed with each other.

Moreover, the mixing chamber comprising the container, the obstacle structure and the connection piece (which form one continuous part) can be easily mounted in a cartridge, for example.

Further advantageous embodiments of the disclosure are set forth herein.

Here, "component" means a liquid, a gas or a particle. The "first component and second component" can also just mean two different states of the same substance: for example, the first component can be an agglomerated form and the second component a liquid form of the same substance.

Here, "magnetic force" means the force acting on a conductor, through which current flows in an electrical field, or on a magnet, in particular a permanent magnet, in a magnetic field.

In one embodiment of the mixing chamber according to the disclosure, the connection piece is formed in one piece with the container and/or with the obstacle structure. Here, "in one piece" means that the connection piece, the container and/or the obstacle structure are formed from one and the same material. Thus, for example, the connection piece, the container and/or the obstacle structure can be easily produced by injection molding.

In another embodiment of the mixing chamber according to the disclosure, the connection piece is connected to a frame, which is connected, in particular adhesively bonded, to the container. This measure also allows the obstacle structure to be connected easily to the container. The frame can be connected in particular to an upper peripheral edge of the container. Instead of the frame, another structural part could also be used.

In another embodiment of the mixing chamber according to the disclosure, the connection piece is flexible or designed with a hinge. In this way, the mobility for moving the obstacle structure through the first component and second component in the container can be easily provided, and at the same time the one-part design of connection piece, container and obstacle structure is retained. Here, "one-part" means that the corresponding parts, in particular the connection piece, the container and the obstacle structure, form one continuous part.

In another embodiment of the mixing chamber according to the disclosure, the connection piece is elastic, in order to generate a restoring force that counteracts the centrifugal force and/or magnetic force. If the centrifugal force and/or magnetic force drops below a predetermined threshold value or is completely lost, this design has the effect that the obstacle structure moves automatically back out of the first component and second component in the container, and/or the obstacle structure moves through the first component and second component in the direction of the rotation point. Therefore, if a corresponding centrifuge with the mixing chamber is operated in such a way that the speed of rotation of the centrifuge oscillates around the aforementioned threshold value, the obstacle structure moves constantly in and out of the first component and second component and/or moves constantly to and fro through the first component and second component, such that the first component and second component are thoroughly mixed together.

Alternatively, the restoring force can also be generated by a further magnetic force. In this case, the connection piece does not need to be made elastic.

In another embodiment of the mixing chamber according to the disclosure, the connection piece is connected to an edge or bottom of the container. This is advantageous from the point of view of manufacturing.

In another embodiment of the mixing chamber according to the disclosure, a spike is provided on the obstacle structure and is designed such that, under the effect of the centrifugal force and/or magnetic force, it pierces a membrane closing an opening in the bottom of the container. Thus, by suitable choice of the speed of rotation of a centrifuge with the mixing chamber, a hole can be generated in the membrane, through which hole the first component and second component can flow out of the container.

In another embodiment of the mixing chamber according to the disclosure, the obstacle structure is designed as a beam, a rake, a sieve or a grid structure. All of these structures are very suitable for mixing the first component and second component together.

In another embodiment of the mixing chamber according to the disclosure, the connection piece is arranged asymmetrically with respect to the obstacle structure, such that the obstacle structure twists, in particular elastically twists, the connection piece under the effect of the centrifugal force and/or magnetic force. By means of this design, the obstacle structure can rotate about an additional axis. The first axis of rotation results, for example, from the fact that the connection piece is flexible or elastic and thus bends under the effect of the centrifugal force and/or magnetic force. A further axis of rotation then results from the fact that the connection piece is arranged asymmetrically with respect to the obstacle structure, the further axis of rotation being provided by means of the twisting of the connection piece.

According to another embodiment, the cartridge according to the disclosure furthermore has: a first drum, which has a first chamber, an adjustment mechanism, which is designed to rotate the first drum about the center axis thereof when the centrifugal force exceeds a predetermined threshold value, in order thereby to connect the first chamber conductively to a second chamber, wherein the first and/or second chamber is designed as the mixing chamber. Advantageously, by suitable choice of the speed of rotation of a centrifuge with the cartridge, it is thus possible for the first and/or second component to be transferred between the first chamber and second chamber. Depending on whether the first and/or second chamber is designed as mixing chamber, the corresponding components can be effectively mixed in the first and/or second chamber. Here, "conductively" means in a manner conducting liquid, gas and/or particles.

In another embodiment of the cartridge according to the disclosure, the adjustment mechanism comprises a first bevel, which cooperates with a second bevel of the first drum in order to move the latter from a first position, in which the first drum is in form-fit engagement with a housing of the cartridge in the direction of rotation about the center axis, to a second position along the center axis and counter to the effect of a restoring means, in which second position the form-fit engagement is canceled and the first drum rotates about the center axis. Thus, a simple mechanism is made available for adjusting the first drum between at least two defined positions in the direction of rotation about the center axis.

In another embodiment of the cartridge according to the disclosure, the second chamber and/or a third chamber of the first drum is mounted upstream or downstream in relation to the center axis, wherein the first chamber can preferably be connected conductively by means of the adjustment mechanism either to the second chamber or to the third chamber. The mixing chamber can thus be mounted upstream and/or downstream from the first drum or can even be provided in the first drum itself. Moreover, the mixing chamber can preferably be optionally connected to various further chambers depending on requirements.

In another embodiment of the cartridge according to the disclosure, a second drum is provided, which has the second chamber, and/or a third drum is provided, which has the third chamber. However, it is also equally possible, for example, that the second drum has the second chamber and the third chamber. The same applies to the third drum. By providing several drums which in particular have several chambers and which are adjusted relative to one another, a wide variety of processes can be performed automatically by means of the cartridge.

BRIEF DESCRIPTION OF THE DRAWINGS

Illustrative embodiments of the disclosure are explained in more detail in the following description and are shown in the figures in the drawing, in which.

Unless otherwise stated, identical reference signs in the figures designate identical elements or elements that have identical functions.

DETAILED DESCRIPTION

Figure 1:
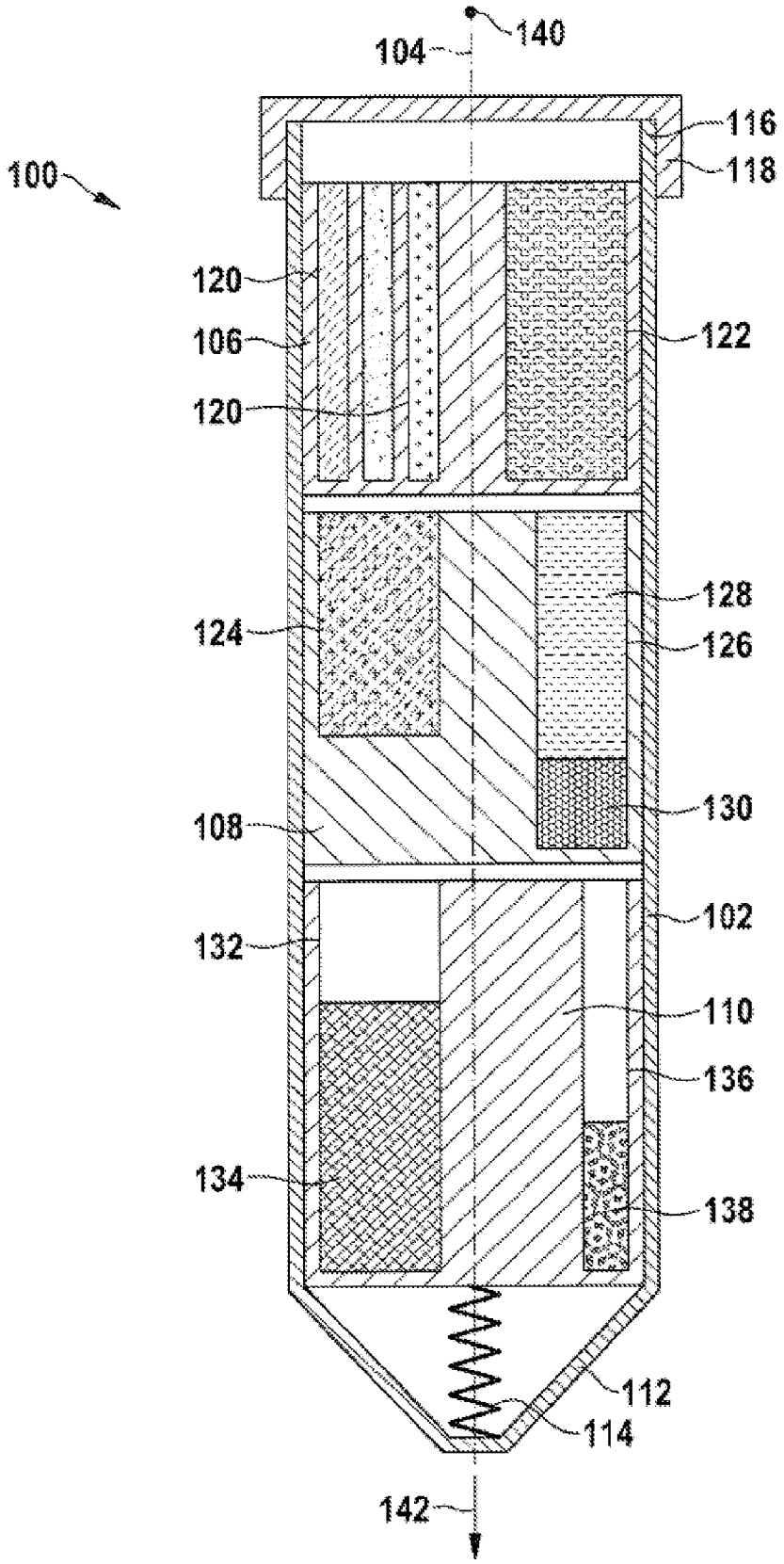
FIG. 1 shows a schematic cross section through a cartridge according to an illustrative embodiment of the present disclosure.

FIG. 1 shows a sectional view of a cartridge 100 according to an illustrative embodiment of the present disclosure.

The cartridge 100 comprises a housing 102 in the form of a small tube. For example, the housing 102 can be designed as a 5 to 100 ml centrifuge tube, in particular a 50 ml centrifuge tube, a 1.5 ml or 2 ml Eppendorf tube, or alternatively as a microtiter plate (e.g. 20 μl per cavity). The longitudinal axis of the housing 102 is designated by 104.

The housing 102 accommodates, for example, a first drum 108, a second drum 106 and a third drum 110. The drums 106, 108, 110 are arranged in succession and with their respective center axes arranged coaxially with respect to the longitudinal axis 104.

The housing 102 is closed at one end 112. A restoring means, for example in the form of a spring 114, is arranged between the closed end 112 and the third drum 110 adjacent thereto. The spring 114 can be designed in the form of a coil spring or of a polymer, in particular an elastomer. The other end 116 of the housing 102 is closed by means of a closure piece 118. The closure piece 118 can preferably be taken off in order to remove the drums 106, 108, 110 from the housing 102. Alternatively, the housing 102 itself can also be dismantled in order to remove the drums 106, 108, 110 or to access the chambers, for example the chamber 136.

According to another illustrative embodiment, the spring 114 is arranged between the closure piece 118 and the second drum 106, such that the spring 114 is expanded in order to generate a restoring force. Other arrangements of the spring 114 are also conceivable.

A respective drum 106, 108, 110 can have one or more chambers:

Thus, for example, the second drum 106 comprises several chambers 120 for reagents and a further chamber 122 for receiving a sample, for example a blood sample, which has been taken from a patient.

The first drum 108, downstream of the second drum 106, comprises a mixing chamber 124 in which the reagents from the chambers 120 are mixed with the sample from the chamber 122. Moreover, the first drum 108 comprises, for example, a further chamber 126 in which the mixture 128 from the mixing chamber 124 flows through a solid phase 130. The solid phase 130 can be a gel column, a silica matrix or a filter.

The third drum 110, arranged in turn downstream from the first drum 108, comprises a chamber 132 for receiving a waste product 134 from the chamber 126. Moreover, the third drum 110 comprises a further chamber 136 for receiving the desired end product 138.

The cartridge 100 has an outer geometry such that it can be placed in a seat of a centrifuge, in particular in a seat of a swinging-bucket rotor or fixed-angle rotor of a centrifuge. During the centrifuging procedure, the cartridge 100 is rotated at high speed about a rotation point 140 indicated schematically in FIG. 1. The rotation point 140 lies on the longitudinal axis 104, such that a corresponding centrifugal force 142 acts on each structural part of the cartridge 100 along the longitudinal axis 104.

The aim now is to control various processes inside the cartridge 100 by means of suitably controlling the speed of rotation. Thus, for example, the mixing chamber 124 is first of all intended to be brought into fluidic communication with the chamber 122, in order to receive the sample from the chamber 122. Thereafter, the mixing chamber 124 is to be connected to the chambers 120 in order to receive the reagents from these. The reagents and the sample are then to be mixed in the mixing chamber 124 at a controlled speed of rotation. Similarly, the processes in the chambers 126, 132 and 136 are also intended to take place at a controlled speed of rotation.

FIGS. 2A-2G show perspective views of various structural parts of the cartridge 100 from FIG. 1. With reference to FIGS. 2A-2G, an adjustment mechanism 300 in particular (see FIG. 3A) will be described below which permits the speed-dependent control of the above-mentioned processes.

Figure 2A:
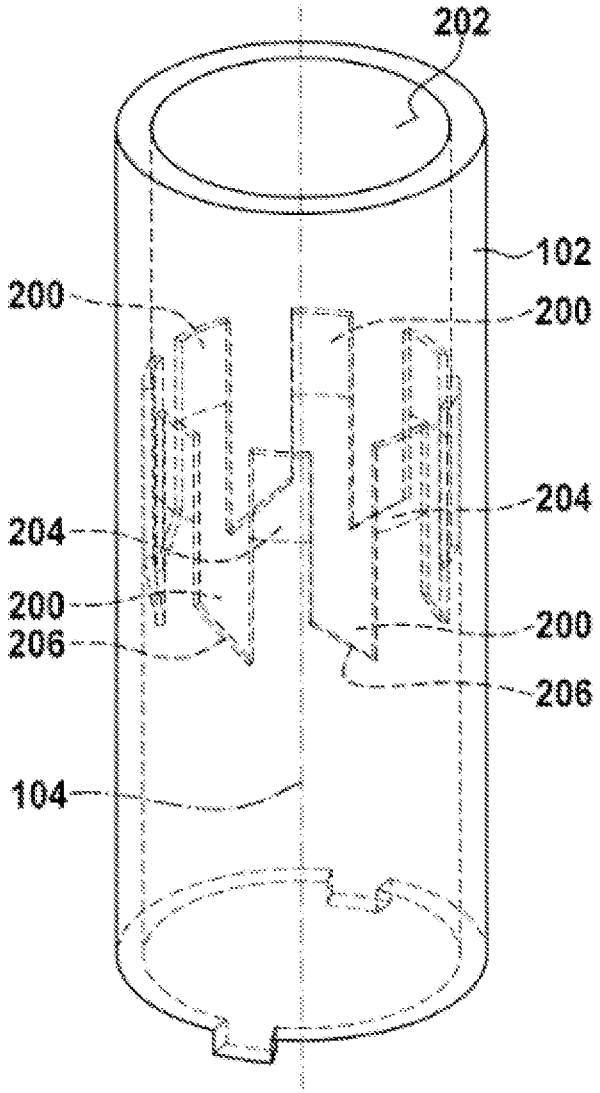
FIGS. 2A-2G show perspective views of different structural parts of the cartridge from FIG. 1.

As is shown in FIG. 2A, the housing 102 has projections 200 on its inside. The projections 200 protrude radially from the inner wall 202 of the housing toward the longitudinal axis 104. Between them, the projections 200 form slits 204, which extend along the longitudinal axis 104. At one end, the projections 200 are each formed with a bevel 206. The bevels 206 point away from the rotation point 140 during operation of the centrifuge with the cartridge 100.

Figure 2B:
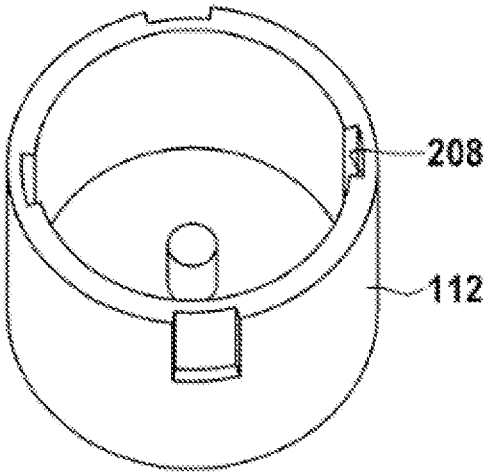

FIG. 2B shows the end 112 of the housing 102, which end 112 is designed in this illustrative embodiment as a detachable cap. The end 112 has, on its inner circumference, several grooves 208, which extend along the longitudinal axis 104.

Figure 2C:
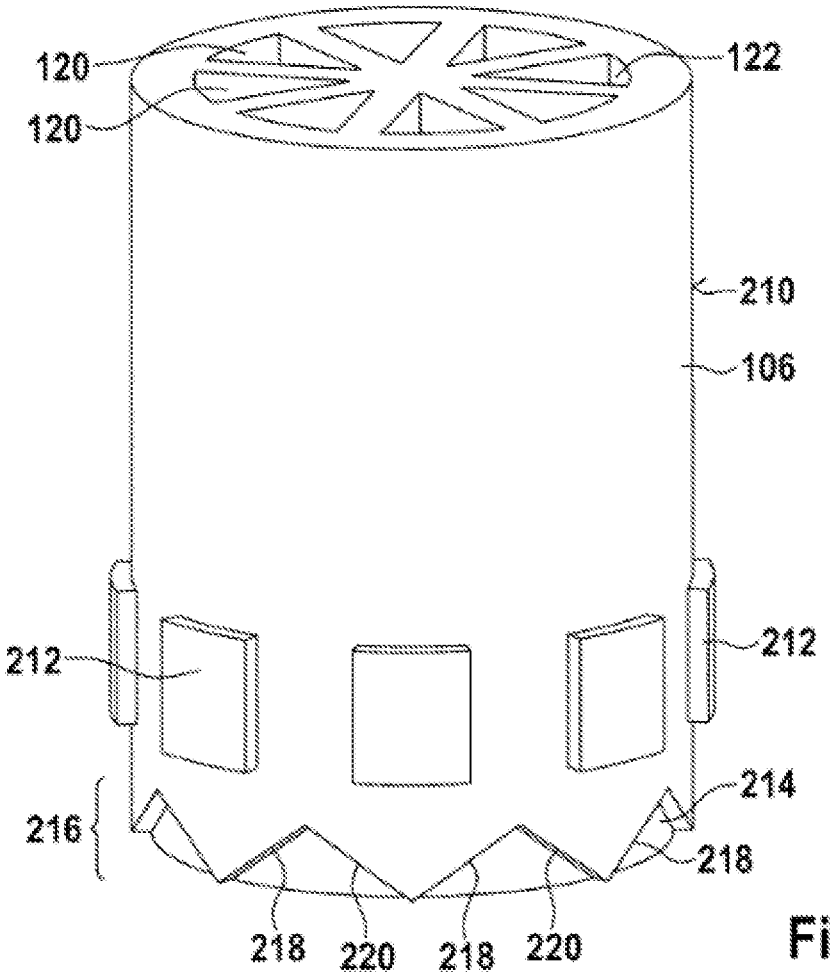

FIG. 2C shows the second drum 106 with the chambers 120, 122. The second drum 106 has, on its outer wall 210, several projections 212, which extend radially outward from the outer wall 210. In the assembled state of the cartridge 100, the projections 212 of the second drum 106 engage in the slits 204 of the housing 102. This blocks a rotation of the second drum 106 about the longitudinal axis 104. However, the second drum 106 is movable in the slits 204 along the longitudinal axis 104. On its outer wall 210, in particular on its end 214 directed toward the first drum 108, the second drum 106 furthermore has a crown-like contour 216, which comprises a large number of bevels 218, 220. Two bevels 218, 220 in each case form a tooth of the crown-like contour 216. The bevels 218, 220 likewise point away from the rotation point 140 during operation of the centrifuge with the cartridge 100.

Figure 2D:
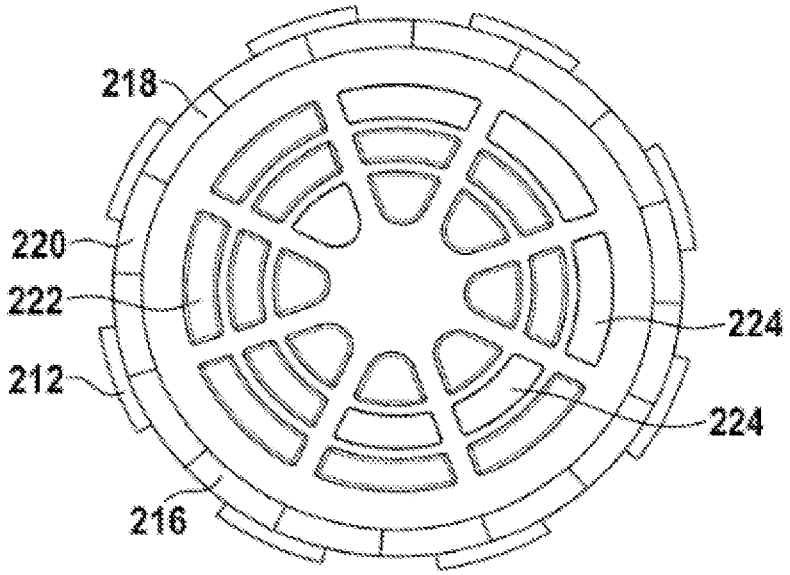

FIG. 2D shows a bottom view of the second drum 106 from FIG. 2C. The underside 222 of the second drum 106 assigned to the end 214 has several openings 224 in order to connect the chambers 120, 122 to the mixing chamber 124 of the first drum 108 in a liquid-conducting, gas-conducting and/or particle-conducting manner (hereinafter "conductively"). Alternatively or in addition, the openings 224 can also conductively connect the chambers 120, 122 to the chamber 126 of the first drum 108. A respective conductive connection is determined by the position of a respective opening 224 with respect to the chambers 124, 126. This position is reached by rotating the first drum 108 relative to the second drum 106, as will be explained in more detail later.

Figure 2E:
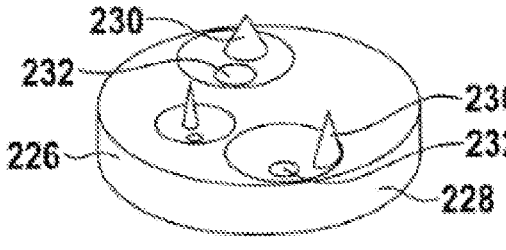

FIG. 2E shows a lancet device 226, which is not shown in FIG. 1. The lancet device 226 comprises a plate 228 with one or more spikes 230, which are each arranged adjacent to an opening 232 in the plate 228. The spikes 230 serve to pierce a respective opening 224 in the underside 222 of the second drum 106 at a controlled speed of rotation, after which liquid in particular flows from the corresponding chamber 120, 122 through the opening 232 into the chambers 124 or 126.

Figure 2F:
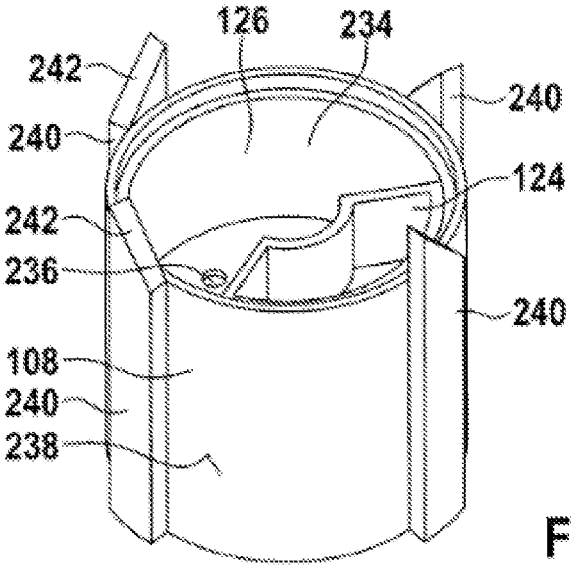

FIG. 2F shows the first drum 108 with the chambers 124, 126. At the bottom 234 of the chamber 126, an opening 236, for example, is provided for conductively connecting the chamber 126 to the chambers 132, 136 of the third drum 110. On its outer wall 238, the first drum 108 has several projections 240. The projections 240 are designed to engage in the slits 204 (like the projections 212 of the second drum 106). As long as the projections 240 are in engagement with the slits 240, a rotation of the first drum 108 about the longitudinal axis 104 is blocked. However, the projections 240 together with the first drum 108 are movable along the longitudinal axis 104 in the slits 204. The projections 240 have bevels 242, which point in the direction of the rotation point 140 during operation of the centrifuge with the cartridge 100 and are formed corresponding to the bevels 206 and 220.

Figure 2G:
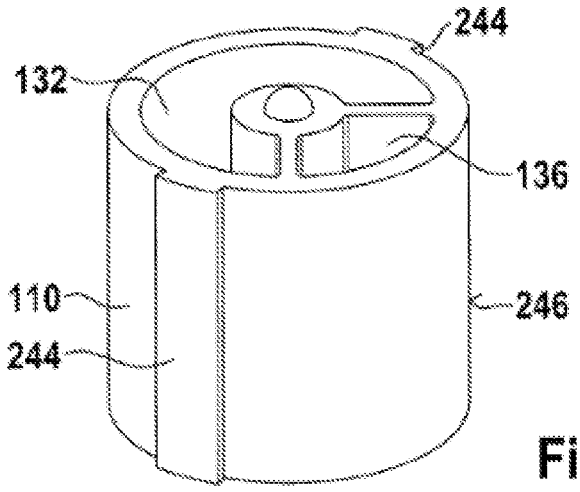

FIG. 2G shows the third drum 110 with the chambers 132, 136. The third drum 110 has projections 244 each protruding from the outer wall 246 of the third drum 110. The projections 244 are designed to engage in the grooves 208 of the end 112, such that the third drum 110 is movable in the grooves 208 in the longitudinal direction 104. However, a rotation of the third drum 110 about the longitudinal axis 104 is thus blocked.

Figure 3A:
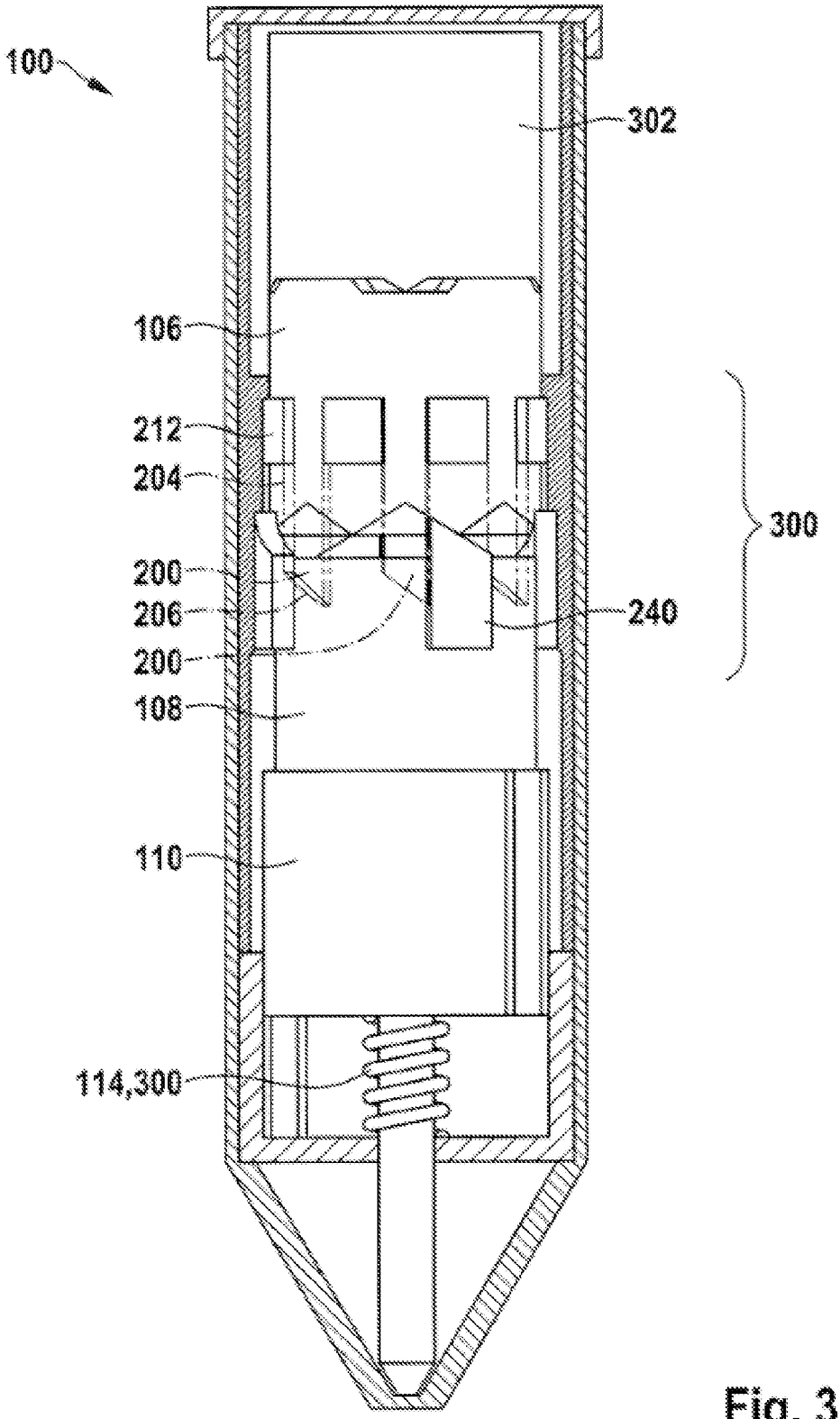
FIGS. 3A-3E show different operating states of the cartridge from FIG. 1.
Figure 3B:
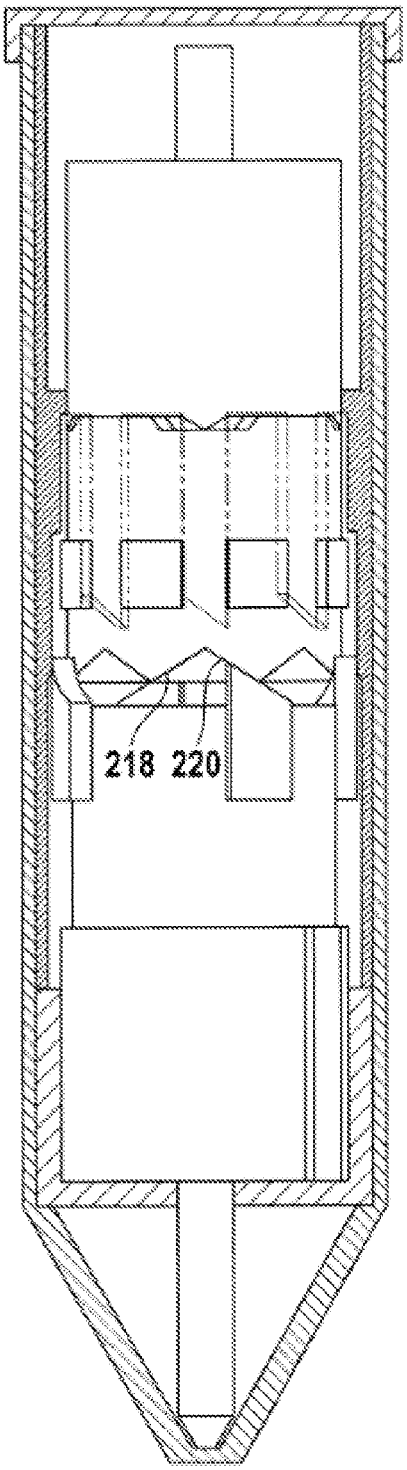
Figure 3C:
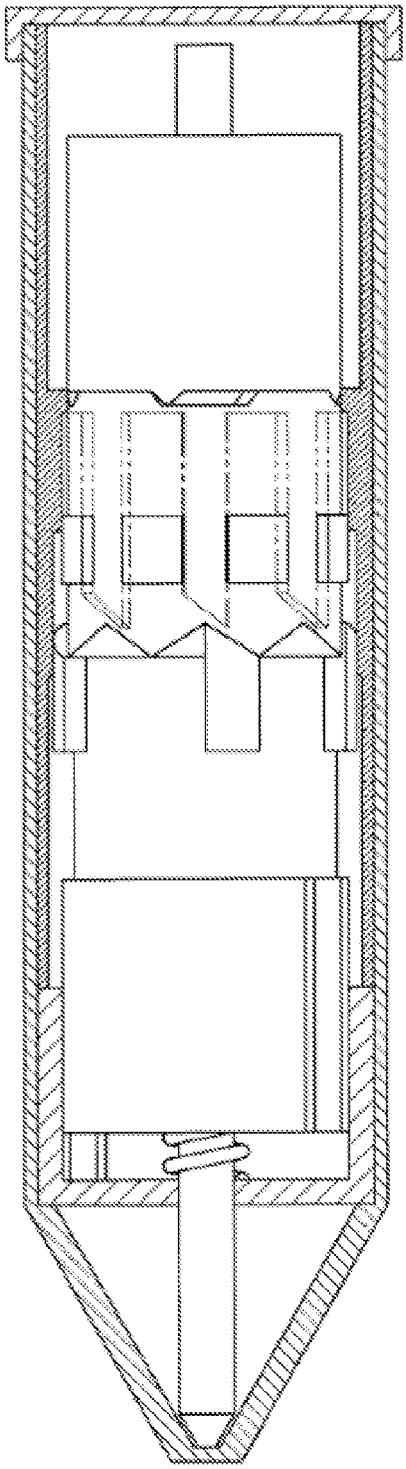
Figure 3D:
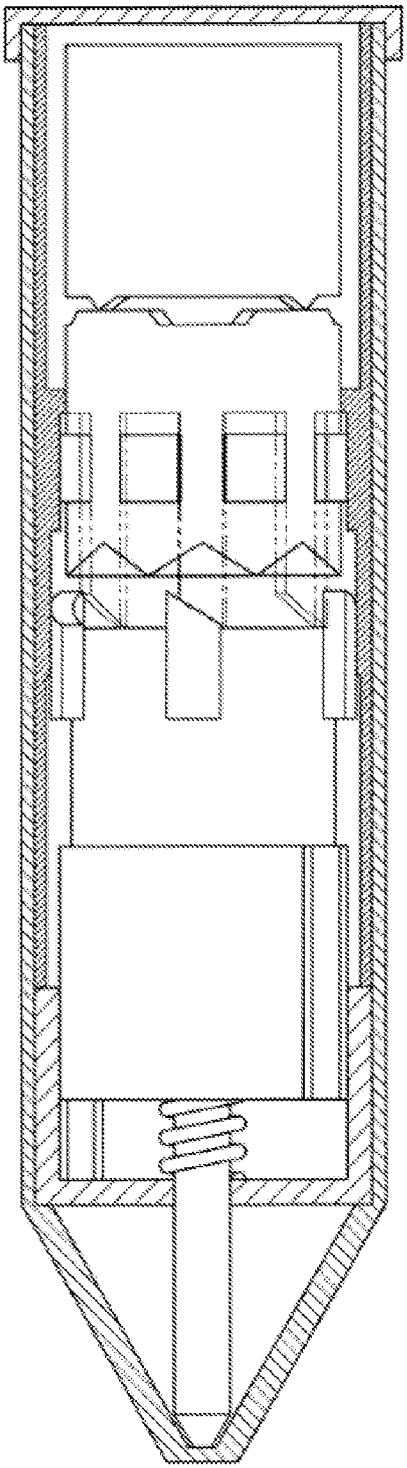
Figure 3E:
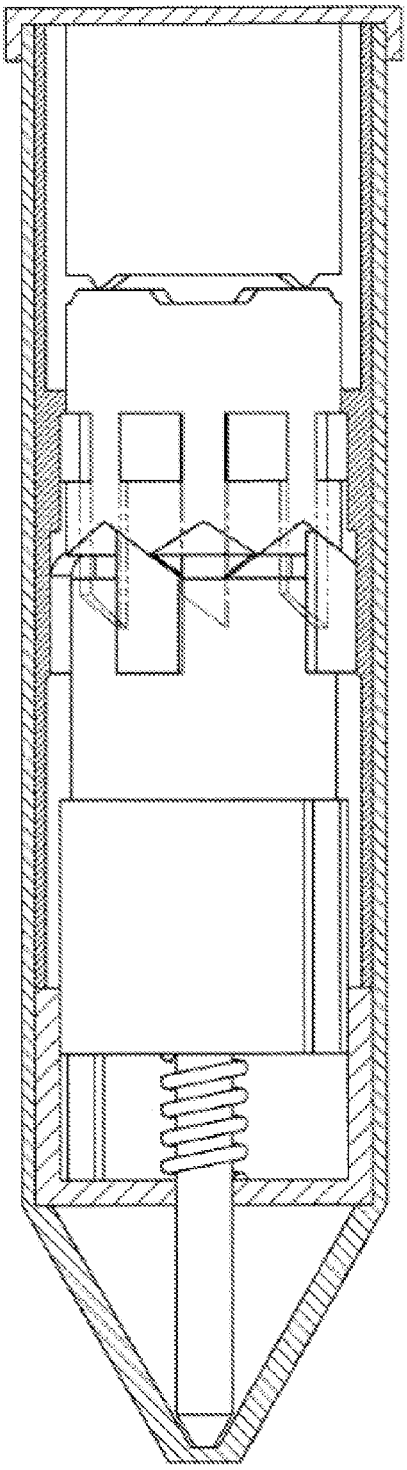

FIGS. 3A-3E show several operating states in the operation of the cartridge 100 from FIG. 1, with an additional drum 302 being shown, although this is of no further relevance in this case. FIGS. 4A-4E each correspond to FIGS. 3A-3E and illustrate the movement of the bevels 206, 218, 220, 242 relative to one another. However, it will also be noted that FIG. 3B shows an operating state of the cartridge 100 that is more advanced than the state shown in FIG. 4B. In FIGS. 3A-3E, the housing 102 is shown partially in section in order to reveal the interior.

The projections 200, the slits 204, the bevels 206, the projections 212, the bevels 218, 220, the projections 240 and the bevels 242 form, together with the restoring spring 141, the aforementioned adjustment mechanism 300 for defined rotation of the first drum 108 relative to the second drum and third drum 110 about the longitudinal axis 104.

Figures 4A, 4B, 4C, 4D, 4E:
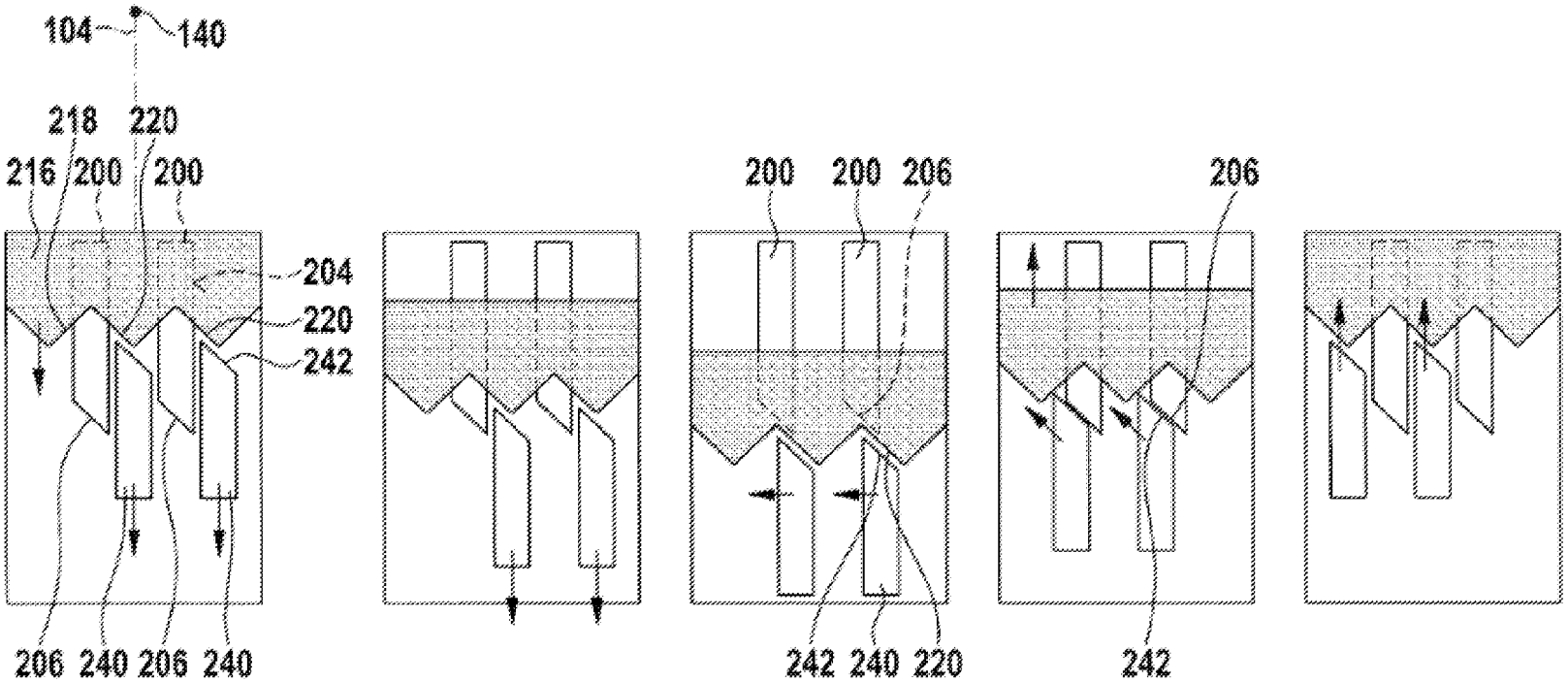
FIGS. 4A-4E show detailed views of an adjustment mechanism according to the different operating states from FIGS. 3A-3E.

FIGS. 3A and 4A show a first position, in which the projections 240 of the first drum 108 engage in the slits 204 and a rotation of the first drum 108 about the longitudinal axis 104 is thus blocked. If the speed of rotation of the centrifuge is now increased, the second drum 106, by means of the bevels 220 of the contour 216, presses on the bevels 242 of the first drum 108 counter to the action of the spring 114, and the spring 114 is compressed. In this way, the first drum 108 moves in a direction away from the rotation point 140, as is indicated by the corresponding arrows in FIGS. 4A and 4B. This movement is continued until the projections 240 disengage from the projections 200. In this second position, a rotation of the first drum 108 about the longitudinal axis 104 is enabled, as is illustrated in FIG. 4C. By virtue of the interaction of the bevels 220 and 242, which for example are each oriented at an angle of 45° in relation to the longitudinal axis 104, a force component is obtained which automatically rotates the first drum 108 when the latter reaches the second position, as is indicated by arrows pointing to the left in FIG. 4C.

If the speed of rotation is now reduced again, which is associated with a corresponding reduction in the centrifugal force, the spring 114 presses the first drum 108 back in the direction of the rotation point 140 by means of the third drum 110. In this way, the second drum 106 and its bevels 220 are likewise moved back in the direction of the rotation point 140, as a result of which the bevels 242 of the first drum 108 come to lie against the bevels 206 of the housing 102 and, performing a further rotation movement of the first drum 108, slide along these to a third position, as is shown in FIGS. 4D and 4E. In the third position, the projections 240 of the first drum 108 are once again arranged in the slits 204 of the housing 102, such that a further rotation of the first drum 108 about the longitudinal axis 104 is blocked again.

The process described above can be repeated as often as required in order to rotate the first drum 108 in a defined manner relative to the second drum 106 and third drum 110.

Figure 5A:
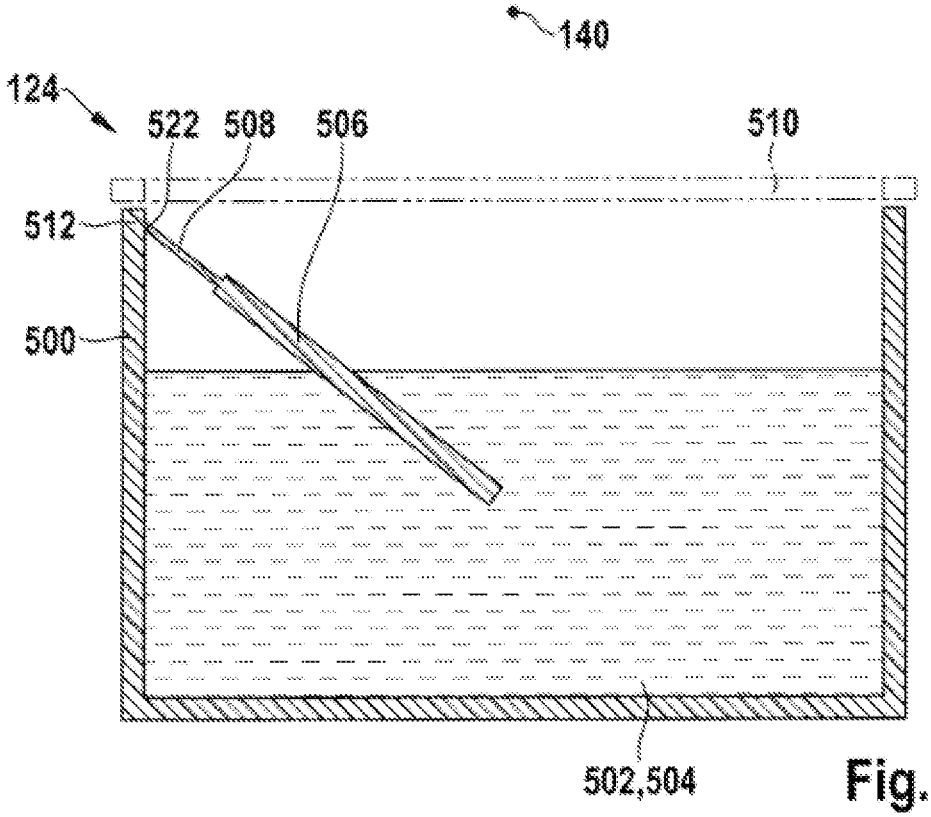
FIG. 5A shows a sectional view of a mixing chamber according to an illustrative embodiment of the present disclosure.

FIG. 5A shows, in cross section, the mixing chamber 124 from FIG. 1 according to an illustrative embodiment of the present disclosure. However, it would be equally possible for one of the chambers 120, 122 of the second drum 106 or even one of the chambers 132, 136 of the third drum 110, which are arranged upstream and downstream of the first drum 108, to be designed corresponding to the mixing chamber 124.

The mixing chamber 124 comprises a container 500 for receiving at least two components. These are preferably components that are supplied by means of the second drum 106. For example, the components can be in the form of reagents or samples, in particular blood samples. FIG. 5A shows the container 500 holding a mixture of two liquids 502, 504. The liquids 502, 504 can have the same density or a different density. The volume of liquid that can be received in the container 500 is typically up to 3 ml.

The mixing chamber 124 also has an obstacle structure 506, which is designed to move through the liquids 502, 504 under the effect of a centrifugal force (i.e. if the speed of rotation of the centrifuge exceeds a predetermined threshold value) in order to mix these liquids together.

Moreover, a connection piece 508 is provided, which connects the obstacle structure 506 to the container 500. The obstacle structure 506 thus forms, together with the connection piece 508 and the container 500, a single part that is easy to handle, in particular easy to assemble. At the same time, however, the obstacle structure 506 is provided to be movable relative to the container 500 in order to perform its mixing function.

For example, the obstacle structure 506 and the connection piece 508 and container 500 can be made from one piece, that is to say produced from the same material. This can be easily achieved, for example, by injection molding of the obstacle structure 506, the connection piece 508 and the container 500.

Alternatively, the connection piece 508, at its container-side end, can be connected to a frame 510 (since this is another illustrative embodiment, the frame 510 is shown by broken lines). The frame 510 is in turn connected, in particular adhesively bonded, to the container 500, in particular to an upper peripheral edge 512 of the container 500. According to one embodiment, the obstacle structure 506 can be produced in one piece with the connection piece 508 and the frame 510, in particular by injection molding.

In the illustrative embodiment according to FIG. 5A, the connection piece 508 is elastic. The purpose of this is to ensure an automatic restoring of the obstacle structure 506 after the speed of rotation of the centrifuge has been reduced. That is to say, the obstacle structure 506 pivots about the attachment point 522 of the connection piece 508 on the container 500 or frame 510, when the speed of rotation exceeds a predetermined threshold value (e.g. a speed of rotation corresponding to 1000 g acceleration of the mixing chamber 124), and, under the action of the centrifugal force, moves away from the rotation point 140 and into and through the liquids 502, 504. If the speed of rotation is reduced again to below the predetermined threshold value, the obstacle structure 506 pivots back in the direction of the rotation point 140 on account of the elasticity of the connection piece 508. Thus, by controlling the speed of rotation, it is possible to control the movement of the obstacle structure 506 and therefore the mixing of the liquids 502, 504. The mixing chamber 124 is typically designed for a speed of rotation corresponding to 10 000 g acceleration, where "g" means gravitational acceleration.

The mixing is effected in the first instance by the movement of the obstacle structure 506. In addition, when the mixing chamber 124 is used with the above-described cartridge 100, the mixing chamber 124 itself moves along the longitudinal direction 104 away from and toward the rotation point 140, as has been described above. This provides a further mixing effect.

According to an alternative embodiment, instead of an elastic connection piece 508 it would also be possible to use a stiff connection piece, which is connected to the container 500 by means of a hinge. Restoring could then be provided by a separate spring.

Moreover, the mixing chamber 124 can be designed such that further process steps and structures are integrated, e.g. sedimentation structures or channel or siphon structures for conveying and switching the liquids 502, 504.

The container 500, the obstacle structure 506 and/or the connection piece 508 can be produced from the same polymer or from different polymers. The one or more polymers are, in particular, thermoplastics, elastomers or thermoplastic elastomers. Examples are cyclo-olefin polymer (COP), cyclo-olefin copolymer (COC), polycarbonates (PC), polyamides (PA), polyurethanes (PU), polypropylene (PP), polyethylene terephthalates (PET) or polymethyl methacrylates (PMMA).

The obstacle structure 506 and the connection piece 508 can each have a cross section that varies in its respective longitudinal direction. Here, "longitudinal direction" means in particular a direction away from the container 500.

Moreover, at its freely oscillating end, the obstacle structure 508 can have an additional mass, for example in the form of a thickened area or a metallization, in order to increase the inertia effect and therefore the oscillation amplitude upon variation of the speed of rotation.

In a further embodiment, the obstacle structure 508 has at least one magnet, which can be moved by means of an in particular electrical or magnetic field. The magnet, e.g. a metallization or a permanent magnet, for example of iron, is mounted on the obstacle structure 508. The means, in particular coils or permanent magnets, for generating the field are accommodated in the centrifuge housing, for example. The obstacle structure 508 is then deflected counter to the centrifugal force 142, and the centrifuge rotor together with the mixing chamber 124 moves through the field. In this way, the obstacle structure 508 can also be moved, in order thereby to mix the liquids 502, 504 together, when the speed of rotation of the centrifuge is kept constant. Alternatively or in addition, the field itself can also be controlled in terms of its strength and orientation, in order to move the obstacle structure 508. In this case, mixing can even take place without centrifuge.

Figure 5B:
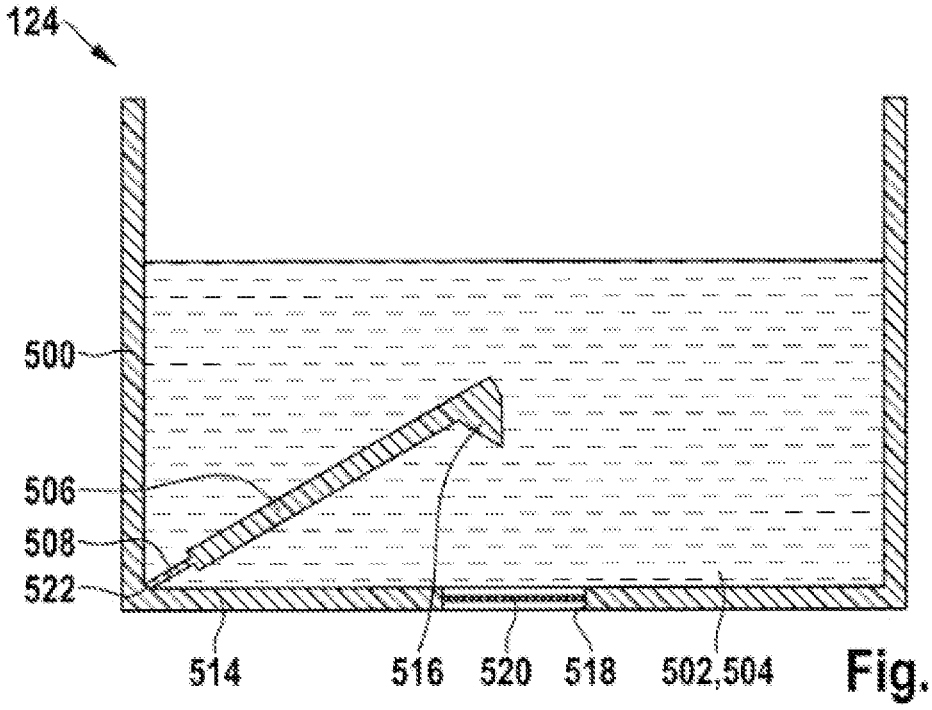
FIG. 5B shows a sectional view of a variant of FIG. 5A according to a further illustrative embodiment of the present disclosure.

FIG. 5B shows a mixing chamber 124 in a variation of the illustrative embodiment according to FIG. 5A.

Whereas, in the illustrative embodiment according to FIG. 5A, the container side of the connection piece 508 is preferably secured on the upper edge 512, the container side of the connection piece 508 in the illustrative embodiment according to FIG. 5B is secured on a bottom 514 of the container 500.

In one embodiment, the free end of the obstacle structure 506 can have a spike 516. An opening 518 is provided in the bottom 514 of the container 500, which opening 518 is closed by a membrane 520 in order to prevent the liquids 502, 504 from flowing out of the container 500.

When the speed of rotation exceeds a predetermined threshold value, the pivoting of the obstacle structure 506 about the attachment point 522 causes the spike 516 to move into the membrane 520 and thereby destroy the latter. The liquids 502, 504 can thus flow out of the container 500. The threshold value is preferably above the threshold value for the mixing of the liquids 502, 504 by means of the obstacle structure 506. This ensures that the liquids 502, 504 are first mixed together, and only then is the membrane 520 pierced.

For example, the opening 518 can be connected to a downstream chamber, for example the chamber 126 of the first drum 108 (see FIG. 1) or one of the chambers 132, 136 of the third drum 110.

FIGS. 6A-6E show, in plan views of FIG. 5A, various embodiments of the obstacle structure 506 that are particularly suitable for mixing the liquids 502, 504 together.

Figure 6A:
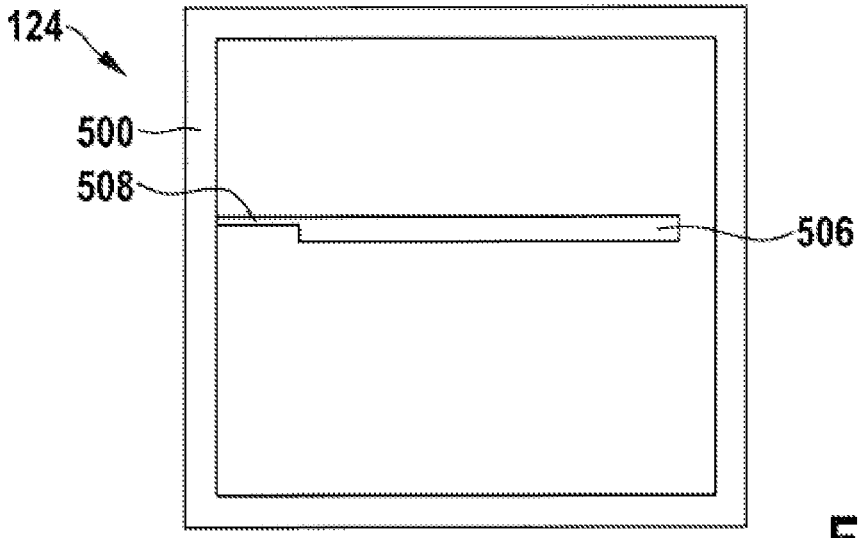
FIGS. 6A-6E show plan views of various illustrative embodiments of mixing chambers according to the disclosure.

In the illustrative embodiment according to FIG. 6A, the obstacle structure 506 is designed in the form of a beam.

Figure 6B:
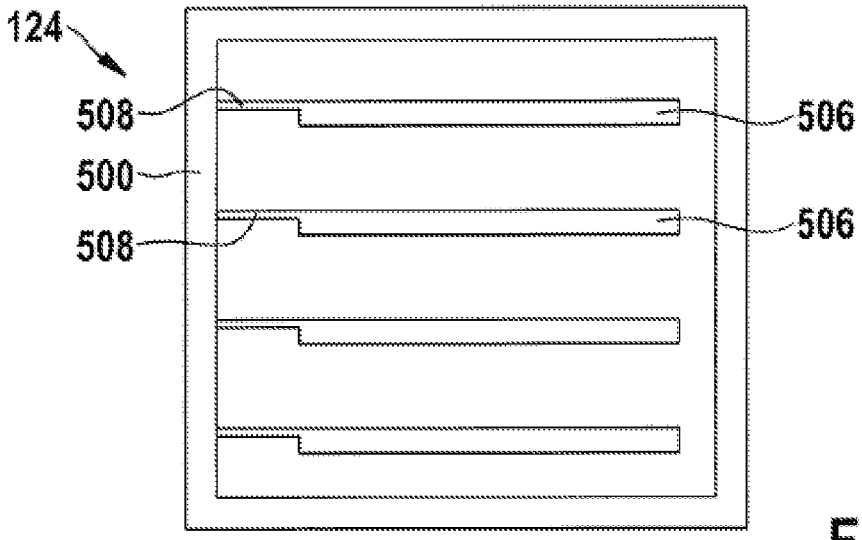

FIG. 6B shows another illustrative embodiment, in which several of the in particular beam-shaped obstacle structures 506 are provided, which are each connected to the container 500 by a connection piece 508.

The beams 506 according to the illustrative embodiments 6A and 6B have, for example, a width of 0.1 to 3 mm. The distance between the beams 506 (illustrative embodiment according to FIG. 6B) can, for example, likewise be between 0.1 and 3 mm. Side struts (not shown) can protrude from the beams 506.

Figure 6C:
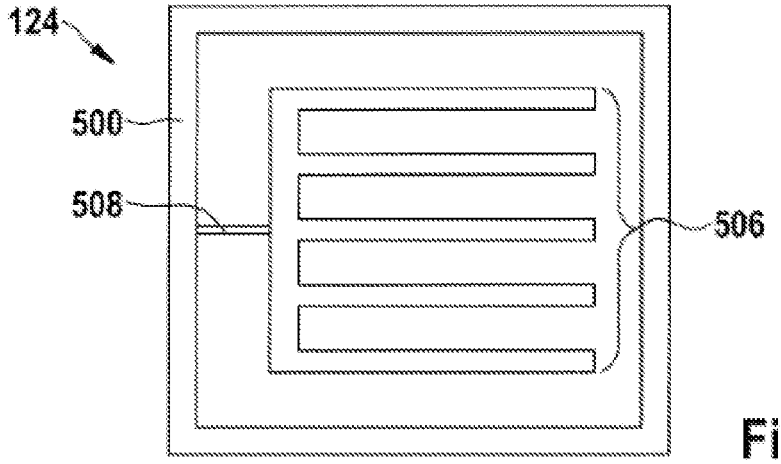

In the illustrative embodiment according to FIG. 6C, the obstacle structure 506 is designed in the form of a rake.

Figure 6D:
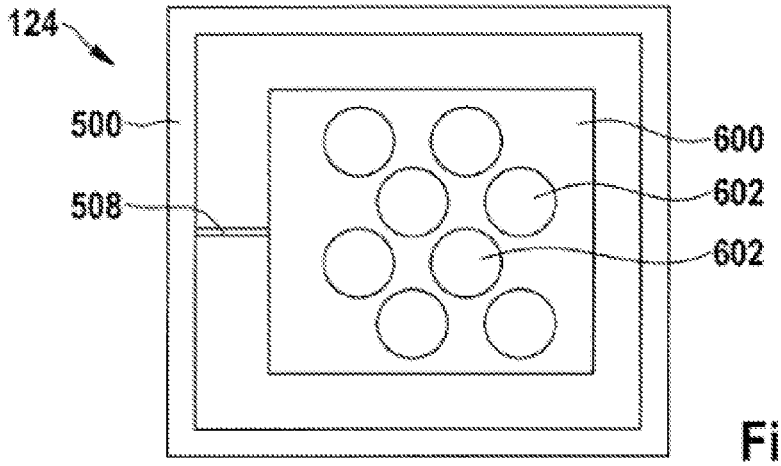

In the illustrative embodiment according to FIG. 6D, the obstacle structure 506 is designed in the form of a sieve, particularly in the form of a plate 600 with several holes 602. The holes 602 can be circular or rectangular. A diameter of a respective hole 602 can be between 0.1 and 3 mm.

Figure 6E:
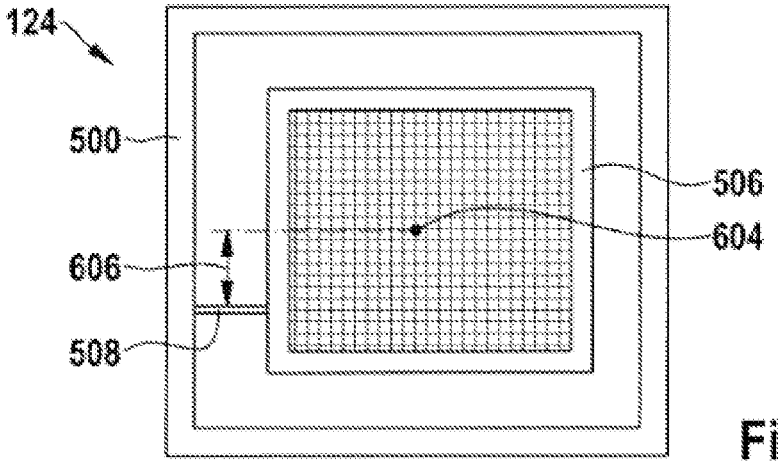

In the illustrative embodiment according to FIG. 6E, the obstacle structure 506 is designed in the form of a grid structure.

Moreover, in the illustrative embodiment according to FIG. 6E (and this is applicable in general to all of the illustrative embodiments described here), a center of gravity 604 of the obstacle structure 506 is arranged with an offset 606 in relation to the longitudinal extent of the connection piece 508. This design is designated here as an "asymmetrical" arrangement of the obstacle structure 506 in relation to the connection piece. Thus, under the effect of the centrifugal force, the connection piece 508 is not only bent, as is the case for example in the illustrative embodiment according to FIG. 5A, but also twisted. Consequently, in the illustrative embodiment according to FIG. 6E, the obstacle structure 506 is pivoted about two different axes, as a result of which the mixing together of the liquids 502, 504 can be improved still further.

Although the disclosure has been described here on the basis of preferred illustrative embodiments, it is not in any way limited to these, and instead it can be modified in many ways. It will be noted in particular that the designs and illustrative embodiments described here for the mixing chamber according to the disclosure can be applied accordingly to the cartridge according to the disclosure and to the method according to the disclosure for mixing a first component and second component, and vice versa. It is also possible for more than two components to be processed. It will further be noted that "a" or "one" in this text does not preclude a multiplicity.

What is claimed is:

1. A centrifuge tube, comprising:

a housing configured to mount in a centrifuge to rotate the housing about a rotation point spaced from the housing; and a mixing chamber disposed within the housing and configured to mix a first component and a second component during rotation of the housing, the mixing chamber including:

a container configured to receive the first component and the second component;

an obstacle structure contained within the container and configured to move relative to the container from a first position to a second position and mix the first component and the second component in the container in response to a change in centrifugal force imparted by rotating the housing between a first rotational speed and a second rotational speed; and a connection piece contained within the container and connected at one end to the container and at a second end to the obstacle structure, the connection piece formed integrally with one or more of the container and the obstacle structure, wherein:

when the housing is rotated at the first rotational speed, a first centrifugal force is imparted on the obstacle structure and positions the obstacle structure at the first position, when the housing is rotated at the second rotational speed, a second centrifugal force is imparted on the obstacle structure and positions the obstacle structure at the second position, and the obstacle structure moves from the first position to the second position when the rotational speed of the housing is changed from the first rotational speed to the second rotational speed.

2. The centrifuge tube according to claim 1, wherein the connection piece is connected to a frame, the frame being connected to the container.

3. The centrifuge tube according to claim 1, wherein the connection piece is flexible.

4. The centrifuge tube according to claim 1, wherein the connection piece is elastic so as to generate a restoring force that counteracts the centrifugal force.

5. The centrifuge tube according to claim 1, wherein the connection piece is connected to an edge or bottom of the container.

6. The centrifuge tube according to claim 1, wherein the obstacle structure includes a spike that, under the effect of the centrifugal force, is configured to pierce a membrane closing an opening in the bottom of the container.

7. The centrifuge tube according to claim 1, wherein the obstacle structure is configured as a beam, a rake, a sieve, or a grid structure.

8. The centrifuge tube according to claim 1, wherein the connection piece is arranged asymmetrically with respect to the obstacle structure such that the obstacle structure twists the connection piece under the effect of the centrifugal force.

9. The centrifuge tube according to claim 2, wherein the frame is adhesively bonded to the container.

10. The centrifuge tube according to claim 8, wherein the obstacle structure elastically twists the connection piece under the effect of the centrifugal force.

11. The centrifuge tube according to claim 4, wherein:

the first centrifugal force defines a predetermined threshold, and if the centrifugal force falls below the predetermined threshold, the restoring force of the connection piece causes the obstacle structure to move out of the first component and the second component.

12. The centrifuge tube according to claim 11, wherein oscillating the rotational speed of the housing above and below the first rotational speed causes the obstacle structure to move constantly in and out of the first component and the second component.

13. The centrifuge tube according to claim 4, wherein:

the first centrifugal force defines a predetermined threshold, and if the centrifugal force falls below the predetermined threshold, the restoring force of the connection piece causes the obstacle structure to move through the first component and the second component in the direction of the rotation point of the housing.

14. The centrifuge tube according to claim 13, wherein oscillating the rotational speed of the housing above and below the first rotational speed causes the obstacle structure to move constantly back and forth through the first component and the second component.

* * * * *